US006769490B2

(12) United States Patent
Allamon et al.

(10) Patent No.: US 6,769,490 B2
(45) Date of Patent: Aug. 3, 2004

(54) DOWNHOLE SURGE REDUCTION METHOD AND APPARATUS

(75) Inventors: Jerry P. Allamon, Montgomery, TX (US); Jack E. Miller, Houston, TX (US); Andrew M. MacFarlane, Houston, TX (US)

(73) Assignee: Allamon Interests, Montgomery, TX (US)

( * ) Notice: Subject to any disclaimer, the term of this patent is extended or adjusted under 35 U.S.C. 154(b) by 0 days.

(21) Appl. No.: 10/188,356

(22) Filed: Jul. 1, 2002

(65) Prior Publication Data

US 2004/0000406 A1 Jan. 1, 2004

(51) Int. Cl.[7] ..... E21B 34/08
(52) U.S. Cl. ..... 166/386; 166/95.1; 166/332.3
(58) Field of Search ..... 166/291, 285, 166/366, 67, 70, 95.1, 332.3

(56) References Cited

U.S. PATENT DOCUMENTS

| | | | | | |
|---|---|---|---|---|---|
| 3,581,819 | A | * | 6/1971 | Tamplen | 166/332.7 |
| 4,862,964 | A | * | 9/1989 | George et al. | 166/297 |
| 5,181,569 | A | * | 1/1993 | McCoy et al. | 166/317 |
| 5,186,258 | A | * | 2/1993 | Wood et al. | 166/387 |
| 5,443,124 | A | * | 8/1995 | Wood et al. | 166/374 |
| 5,462,121 | A | * | 10/1995 | Schmuck et al. | 166/383 |
| 5,960,881 | A | * | 10/1999 | Allamon et al. | 166/291 |
| 6,467,546 | B2 | * | 10/2002 | Allamon et al. | 166/381 |
| 6,491,103 | B2 | * | 12/2002 | Allamon et al. | 166/318 |
| 6,520,257 | B2 | * | 2/2003 | Allamon et al. | 166/291 |
| 2003/0136563 | A1 | * | 7/2003 | Allamon et al. | 166/386 |

* cited by examiner

*Primary Examiner*—David Bagnell
*Assistant Examiner*—Daniel P Stephenson

(74) *Attorney, Agent, or Firm*—O'Neil & McConnell, PLLC; R. Perry McConnell

(57) ABSTRACT

A method and apparatus for use in the oil well industry for running in drilling/production liners and sub-sea casings down a borehole through drilling fluid on a drill pipe using a running tool with the benefits of surge pressure reduction are disclosed. In accordance with the present invention, a surge pressure reduction tool includes a diverter device having a housing with a set of flow holes formed therein and a sliding sleeve residing within the housing having a set of flow ports formed therein. By aligning the set of flow holes of the housing with the set of flow ports of the sleeve, the tool is set in a "surge pressure reduction" mode. By shifting, or axially indexing, the sleeve downward, the set of flow holes is blocked by the sleeve thus setting the tool in a "cementing" or "circulation" mode. This shifting or indexing is accomplished using an indexing mechanism. The indexing mechanism of the present invention includes a spring ring which is initially compressed and set in a circumferential groove formed around the top of the sleeve. As the sleeve is shifted downward from surge reduction mode to cementing/circulation mode, the spring ring decompresses radially outward to engage a circumferential groove formed in the housing. This effectively locks the sliding sleeve in the cementing/circulation mode. In accordance with the present invention, a surge pressure reduction tool further includes a volume compensation device which enables the diverter device to be shifted axially downward into the cementing/circulation mode even where the drilling/production liner or sub-sea casing is plugged with drill cuttings or downhole debris. In the cementing/circulation mode, a flow path is established for cement or drilling fluid to flow downward from the drill pipe, through the diverter device, volume compensation device, and running tool, and out into the borehole via the drilling/production liner or sub-sea casing. In the surge pressure reduction mode, an alternative flow path is established for drilling fluid to flow upward from the borehole into the drilling/production liner or sub-sea casing, through the running tool and volume compensation device, and into an annular space between the drill pipe and the borehole via the set of flow holes of the diverter device.

11 Claims, 7 Drawing Sheets

100
309
315
308A
306
308B
310
303
307
304A
304B
302
311A
305
301
311B 101
407
402
401
400
405
403
406
404

100
309
308A
301
306
304A
315
304B
303
311A
307
312
302
305
311B

DOWNHOLE SURGE REDUCTION METHOD AND APPARATUS

BACKGROUND OF THE INVENTION

1. Field of the Invention

The present invention relates to a downhole surge pressure reduction method and apparatus for use in the oil well industry. More particularly, the method and apparatus of the present invention provides surge pressure reduction functionality while running a drilling/production liner or sub-sea casing down a borehole.

2. Description of the Prior Art

U.S. Pat. No. 5,960,881 ("the '881 patent"), which is incorporated herein by reference and which should be referred to with respect to the advantages provided by that invention, describes the principle of operation of a downhole surge pressure reduction system. The invention of the '881 patent has provided the oil well industry with the capability of running in a drilling/production liner faster and more reliably with a minimum of lost drilling fluid. Particularly, the surge pressure reduction system of the '881 patent includes a diverter device connected between a drill pipe and a drilling/production liner. The diverter device has a housing assembly with a set of flow holes and an axial bore formed therein. A sliding sleeve resides within the axial bore of the housing assembly. When the sliding sleeve is positioned above the set of housing flow holes such that the sleeve does not block the set of flow holes, communication is established between the axial bore of the housing assembly and the annular space between the housing assembly and the borehole. This is called the "open port position" and is established to facilitate surge pressure reduction when running a drilling/production liner through drilling fluid down a borehole. When the sliding sleeve is displaced axially downward such that the set of flow holes of the housing assembly is blocked by the sleeve, communication is interrupted between the axial bore of the housing assembly and the annular space between the housing assembly and the borehole. This is called the "closed port position" and is established to provide circulation of drilling fluid downward through the diverter device and to the bottom of the drilling/production liner without short-circuiting the flow of drilling fluid through the set of flow holes of the housing assembly. The closed port position is also established to facilitate cementing operations when the drilling/production liner reaches total depth of the borehole.

The diverter device disclosed in the '881 patent includes an indexing mechanism to facilitate shifting the sliding sleeve axially downward from the open port position to the closed port position. The indexing mechanism of the '881 patent includes: (1) a yieldable ball seat attached to the sliding sleeve to receive a drop ball, (2) a set of latching fingers formed on the sliding sleeve, (3) an upper groove formed on the inner wall of the housing assembly to receive the latching fingers of the sliding sleeve in the open port position, and (4) a lower groove formed on the inner wall of the housing assembly to receive the latching fingers of the sliding sleeve in the closed port position.

In operation, a drilling/production liner is run down a borehole using a drill pipe and a surge pressure reduction tool attached between the drill pipe and the drilling/production liner. Initially, the tool is set in the open port position to provide surge pressure reduction functionality while the tool is being lowered through drilling fluid down the borehole. In the open port position, the latching fingers of the sliding sleeve engage the upper groove in the housing such that the sliding sleeve does not inhibit communication via the set of flow holes of the housing.

As the drilling/production liner is lowered in the open port position, the drilling fluid flows upward through the drilling/production liner, into the tool, and outward into the annular space between the tool and the borehole via the set of flow holes. Once total depth is achieved, the surge pressure reduction tool must be in the closed port position to facilitate hanging and cementing operations. Therefore, a drop ball is released into the drill pipe to land in the yieldable ball seat thereby effectively sealing the sliding sleeve. Drilling fluid pressure is then increased above the drop ball to disengage the latching fingers from the upper groove of the housing assembly and shift the sliding sleeve axially downward into the closed port position where the latching fingers engage the lower groove of the housing assembly. Drilling pressure is once again increased above the drop ball to push the ball through the yieldable ball seat and out of the bottom of the drilling/production liner.

U.S. application Ser. No. 10/051,270 ("the '270 application"), which is incorporated herein by reference and which should be referred to with respect to the advantages provided by that invention, also discloses a diverter device with an indexing mechanism employing latching fingers. However, the '270 application also describes the principle of operation of a surge pressure reduction apparatus having a volume compensation device.

The volume compensation device of the '270 application provides a solution to problems observed during the running downhole of a drilling/production liner where the liner becomes plugged with drill cuttings and debris. Oftentimes, these drill cuttings and debris are created and left in the borehole during drilling operations. If the drilling/production liner becomes plugged while being run downhole, it may not be possible to shift the sliding sleeve downward into the closed port position. Therefore, with the sliding sleeve unable to shift out of the open port position, cementing operations cannot be performed at total depth and circulation operations cannot be performed if the drilling/production liner encounters a tight hole condition. This is due to a pressure build-up in the drilling fluid trapped between the yieldable ball seat sealed by the drop ball and the debris blocking the drilling/production liner. This pressure build-up causes a hydraulic lock condition in which the trapped drilling fluid resists the force exerted above the drop ball to shift the sliding sleeve axially downward. Therefore, the tool cannot be shifted out of the open port position and communication between the surface and the drilling/production liner via the drill pipe is short-circuited by the open set of flow ports of the tool.

A volume compensation device in accordance with the '270 application may be used to permit the surge pressure reduction tool to be shifted to the closed port position thus facilitating cementing operations and circulation of drilling fluid even in the event that the drilling/production liner becomes plugged with drill cuttings or downhole debris. The volume compensation device is connected between the drilling/production liner and the diverter device; and, when activated, the volume compensation device accumulates a volume of drilling fluid which is equal to or greater than the volume of drilling fluid displaced when the sliding sleeve moves from the open port position to the closed position.

While the inventions of the '881 patent and '270 application provide for more efficient running of drilling/production liners downhole, it has been observed that under certain conditions the indexing mechanism of these prior diverter tools may not function properly to shift the sliding sleeve into the closed port position. There are several reasons for this shifting problem. First, the latching fingers of the indexing mechanism were designed to release and shift the sleeve at low pressures (e.g., 200–300 psi), thus reducing the flexibility of the tool. Also, if the latching fingers of the indexing mechanism were installed in a position high in the housing, then atmospheric pressure is trapped between the lowest two sets of seals. Thus, when the tool is run downhole with the latching fingers in this position, the differential pressure between hydrostatic pressure and the atmospheric pressure creates a "hydraulic lock" condition thus preventing the tool from functioning properly. Another reason for the potential shifting problem is that the seals between the sliding sleeve and the housing assembly of prior diverter devices have been installed on the sleeve rather than on the housing assembly. Thus, the seals cross the housing flow holes during shifting of the sliding sleeve and the seals are exposed to debris and contaminates in the borehole which can damage the seals.

Accordingly, the oil well industry would find desirable a surge pressure reduction tool having a more reliable and easier to assemble indexing mechanism to shift the tool from the open port position to the closed port position.

SUMMARY OF THE INVENTION

In accordance with the present invention, a method and apparatus for reducing surge pressure while running a drilling/production liner or sub-sea casing on a drill pipe with a running tool through drilling fluid down a borehole using a drilling rig is provided. While the present invention is described with respect to running a "drilling/production liner" downhole, it should be understood that the present apparatus and method may also be used for running a "sub-sea casing" downhole.

The surge pressure reduction apparatus in accordance with the present invention includes a diverter device connected between the drill string and the drilling/production liner. The diverter device functions to: (1) facilitate surge pressure reduction when running a drilling/production liner through drilling fluid down a borehole, and (2) provide circulation of drilling fluid through the drilling/production liner to free the drilling/production liner and to facilitate cementing operations once total depth is reached.

In a preferred embodiment, the diverter device of the present invention includes a housing assembly with a set of flow holes formed therein. The housing assembly is suspended from a drill pipe such that the drill pipe provides a communication conduit between the drilling rig on the surface and the borehole. The diverter device further includes a sleeve positioned within the housing assembly and having a set of flow ports formed therein. When the set of flow holes of the housing assembly is aligned with the set of flow ports of the sleeve, the tool is in an "open port position." When the set of flow holes of the housing assembly is blocked by the sleeve, the tool is in a "closed port position." The diverter device of the present invention still further includes an indexing mechanism for moving the sleeve from the open port position to the closed port position. The indexing mechanism includes: (1) a yieldable ball seat attached to the sleeve for receiving a drop ball, (2) a circumferential groove formed along the outer wall of the sleeve and near the upper end of the sleeve, (3) a spring ring installed in the circumferential groove of the sleeve, (4) a circumferential groove formed on the inner wall of the housing assembly to receive the spring ring when the sleeve shifts to the closed port position, and (5) a shear ring and a set of shear pins to hold the sleeve in the open port position. To shift the sliding sleeve axially downward into the closed port position, the drop ball is released into the yieldable seat and drilling fluid pressure is increased above the drop ball to shear the set of shear pins from the shear ring. The quantity of shear pins governs the pressure at which the sleeve is shifted. Accordingly, the indexing mechanism of the present invention can be assembled to shift at a pressure as low as 150 psi to as high as 1400 psi. Once released from the set of shear pins, the sliding sleeve moves axially downward until the spring ring engages the circumferential groove of the housing assembly to lock the sliding sleeve in the closed port position.

The surge pressure reduction apparatus in accordance with the present invention may also include a volume compensation device connected between the diverter device and the drilling/production liner. The volume compensation device, when used, accumulates a volume of drilling fluid which is equal to or greater than the volume of drilling fluid displaced when the sliding sleeve moves from the open port position to the closed position.

In one preferred embodiment, the volume compensation device includes a housing having an upper end and a lower end and an axial bore formed therethrough. Additionally, the housing includes a set of flow ports formed therein near the upper end. The volume compensation device also includes an inner sleeve having an upper end and a lower end, and an outer diameter smaller than the diameter of the axial bore of the housing. The total length of the inner sleeve is less than the length of the axial bore of the housing. The inner sleeve is arranged within the axial bore of the housing, and the upper end of the inner sleeve is attached to the upper end of the housing to form an annular space between the inner sleeve and the housing. An annular piston having an inner diameter approximately equal to the outer diameter of the sleeve and an outer diameter approximately equal to the diameter of the axial bore of the housing is attached to the lower end of the sleeve by at least one shear pin. If the drilling/production liner becomes plugged with drill cuttings or downhole debris, then trapped drilling fluid pressure within the volume compensation plug applies an upward force against the annular piston such that the set of shear pins shear and the annular piston moves axially upward. This provides the apparatus of the present invention with additional volume as required to shift the diverter device to the closed port position.

In the open port position, apparatus in accordance with the present invention provides an alternative flow path for drilling fluid to flow upward from the borehole into the tubular member, from the tubular member to the running tool, from the running tool to the volume compensation device, from the volume compensation device to the diverter device, and from the diverter device out into an annular space between the drill pipe and the borehole via the set of housing flow holes. Providing this flow path facilitates surge pressure reduction when lowering the tubular member downhole through drilling fluid.

In the closed port position, apparatus in accordance with the present invention provides a flow path for drilling fluid to flow downward from the drill pipe to the diverter device, from the diverter device to the volume compensation device, from the volume compensation device to the running tool, from the running tool to the tubular member, and from the tubular member out into the borehole. Providing this flow path facilitates circulation and cementing operations.

In another embodiment of the present invention, the diverter device includes a seal installed on the inner wall of the housing assembly above the set of housing flow holes and a seal installed on the inner wall of the housing assembly below the set of housing flow holes. Since the seals are fixed to the housing assembly rather than to the sleeve, the seals never cross the set of housing flow holes and thus are not exposed to debris and contaminants in the borehole that could damage the seals. Moreover, this arrangement of the seals prevents a hydraulic lock condition from forming when the sleeve is shifted to block the set of flow holes of the housing assembly.

The apparatus of the present invention is an improvement over prior art diverter devices for at least the following reasons: (1) it provides a more reliable indexing mechanism to shift the diverter device, and (2) it reduces the possibility of misassembly by shop personnel.

DESCRIPTION OF SPECIFIC EMBODIMENT

In oilfield applications, a "drilling/production liner" and a "sub-sea casing" are tubular members which are run on drill pipe. The term "sub-sea casing" is used with respect to offshore drilling operations, while the term "drilling/production liner" is used with respect to both land and offshore drilling operations. For ease of reference in this specification, the present invention is described with respect to a "drilling/production liner." In the appended claims, the term "tubular member" is intended to embrace either a "drilling/production liner" or a "sub-sea casing." In the specification and appended claims, the term "operatively connected" is used to mean "in direct connection with" or "in connection with via another element," and the term "set" is used to mean "one or more."

A description of a preferred embodiment of the present invention is provided to facilitate an understanding of the invention. This description is intended to be illustrative and not limiting of the present invention. Furthermore, while one embodiment of the present invention includes a surge pressure reduction apparatus comprising both a diverter device and a volume compensation device, it should be understood that another embodiment of the present invention includes only a diverter device without a volume compensation device.

Figure 1:
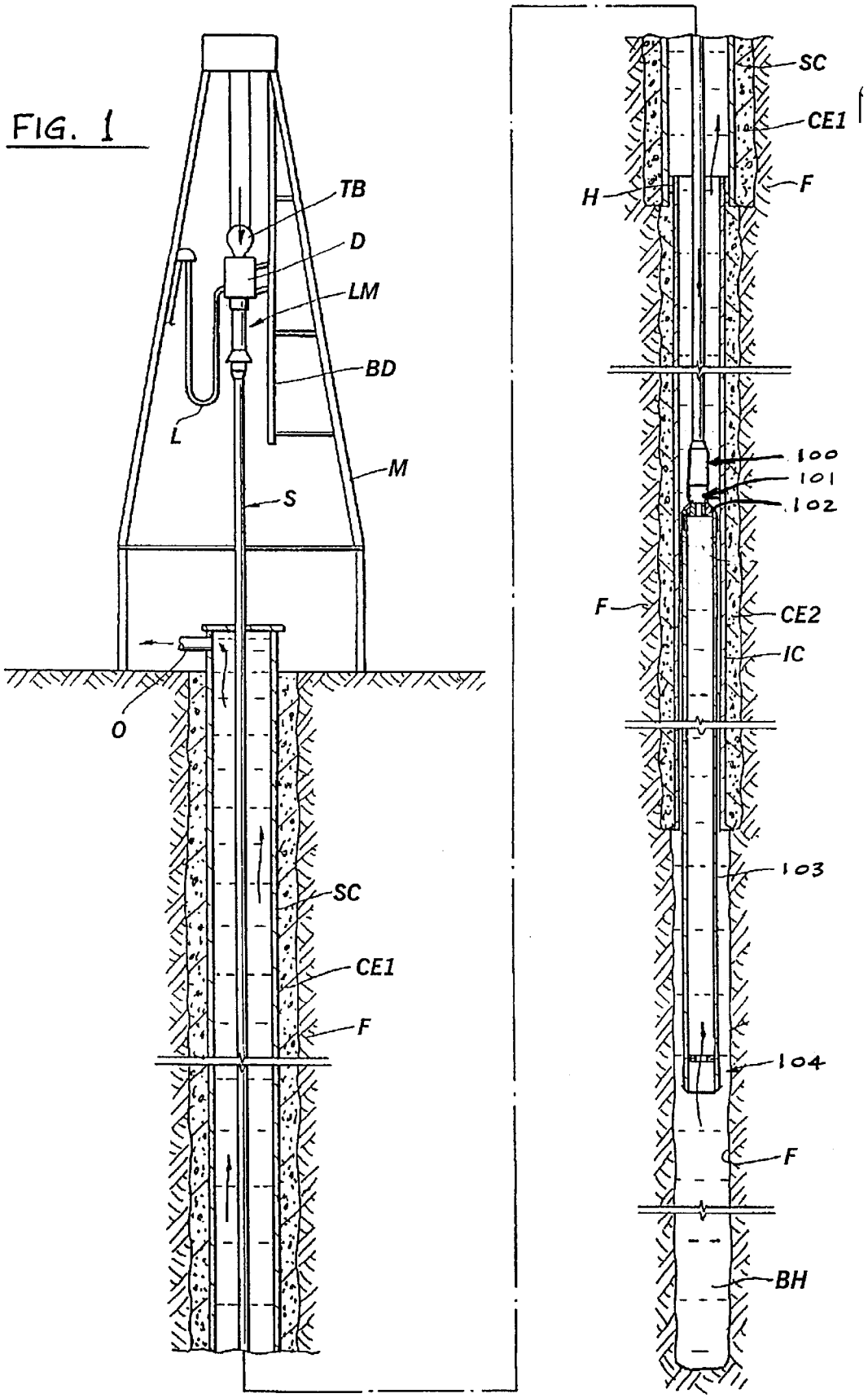
FIG. 1 is an elevation view of a wellbore depicting a drilling/production liner being run downhole on a drill pipe using a surge pressure reduction tool comprising a diverter device and a volume compensation device.

With reference first to FIG. 1, the general components of a system in which a tool in accordance with the present invention is used are illustrated. A mast M suspends a traveling block TB. The traveling block TB supports a top drive D which moves vertically on a block dolly BD. An influent drilling fluid line L supplies the top drive D with drilling fluid from a drilling fluid reservoir (not shown). A launching manifold LM connects to a drill string S. The drill string S comprises a plurality of drill pipe segments which extend down into a borehole BH, and the number of such pipes is dependent on the depth of the borehole BH. A diverter device 100 and volume compensation device 101 in accordance with the present invention are operatively connected between the bottom end of drill string S and the top of running tool 102. The running tool 102 is preferably a casing hanger. A drilling/production liner 103 is suspended from the running tool 102. An open guide shoe 104 is fastened to the bottom of the drilling/production liner 103.

Still with reference to FIG. 1, solidified cement CE1 fixes a surface casing SC to surrounding formation F. The surface casing SC contains an opening O in the uppermost region of the casing adjacent to the top. The opening O controls return of drilling fluid as it travels up the annular space between the drill string S and the surface casing SC. Additionally, solidified cement CE2 fixes an intermediate casing IC to the surrounding formation F. The intermediate casing IC is hung from the downhole end of the surface casing SC by a mechanical or hydraulic hanger H.

Still with reference to FIG. 1, a preferred embodiment of the present invention includes a diverter device 100 having an upper end and a lower end. The upper end of the diverter device 100 is operatively connected to the drill string S. The lower end of the diverter device 100 is operatively connected to a volume compensation device 101. The volume compensation device 101 is operatively connected to a drilling/production liner 103 via a running tool 102.

Figure 2:
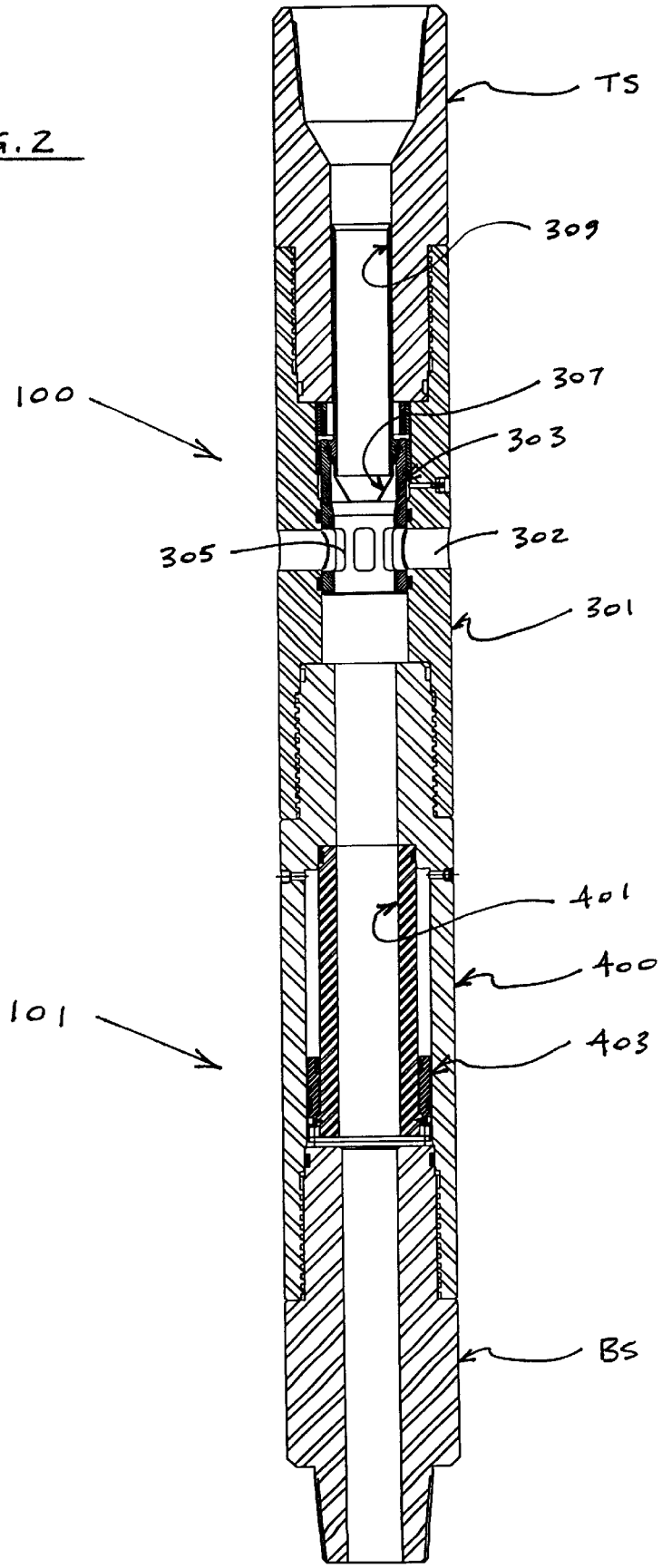
FIG. 2 is a sectional view of a preferred embodiment of the surge pressure reduction tool in accordance with the present invention comprising a diverter device in the open port position and a volume compensation device.
Figure 3:
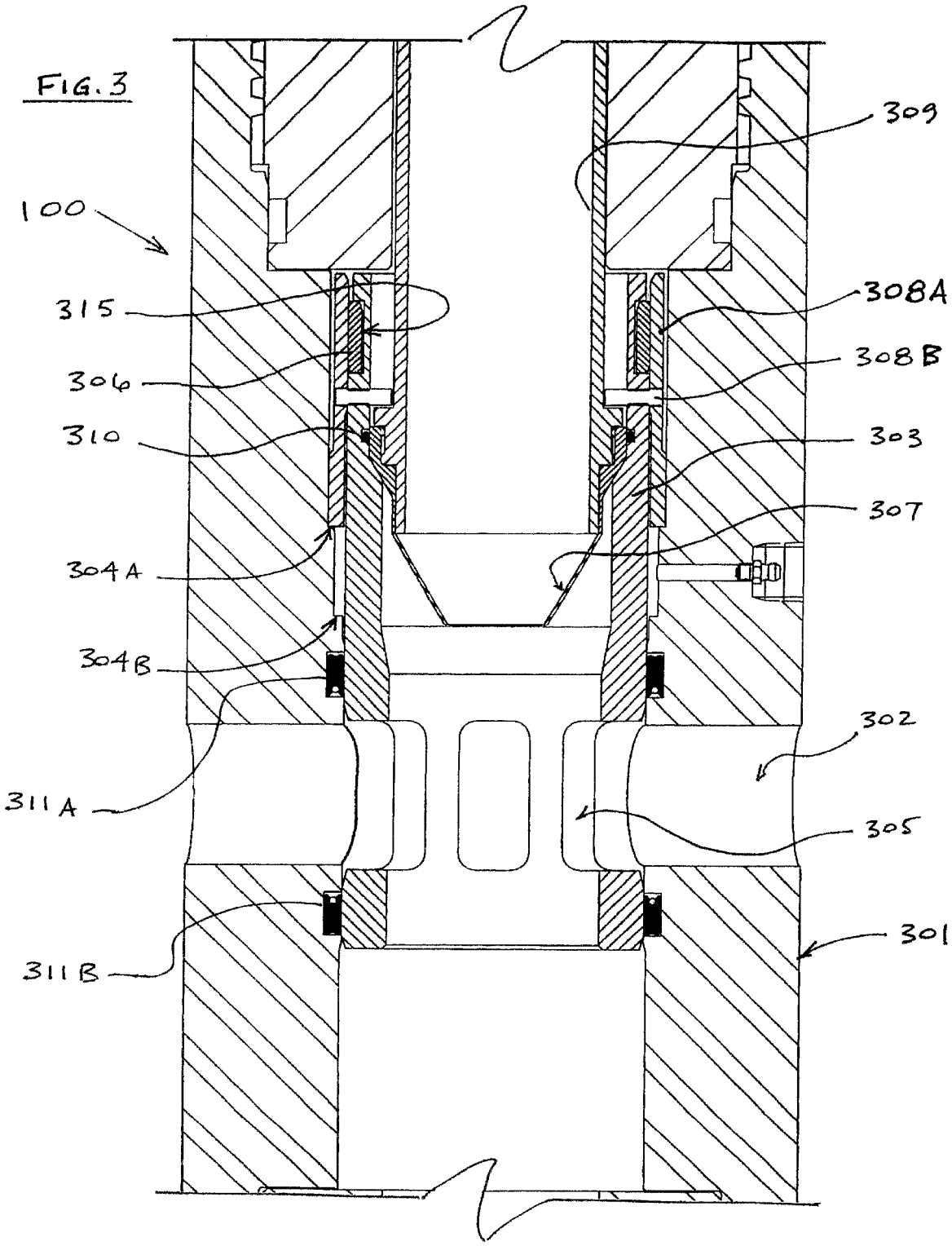
FIG. 3 is an enlarged sectional view of a preferred embodiment of the diverter device in the open port position.

With reference to FIGS. 2 and 3, a preferred embodiment of the present invention includes a diverter device 100 comprising a housing assembly 301 having an upper end, a lower end, and an axial bore therethrough. The upper end of the housing assembly 301 is operatively connected to a top sub TS. The lower end of the housing assembly 301 is operatively connected to a volume compensation device 101. The housing assembly 301 includes a set of flow holes 302 formed therein for establishing communication between the annular space outside the diverter device 100 and the axial bore of the housing assembly. The axial bore of the housing assembly 301 includes an upper circumferential groove 304A and a lower circumferential groove 304B formed therein.

Figure 5:
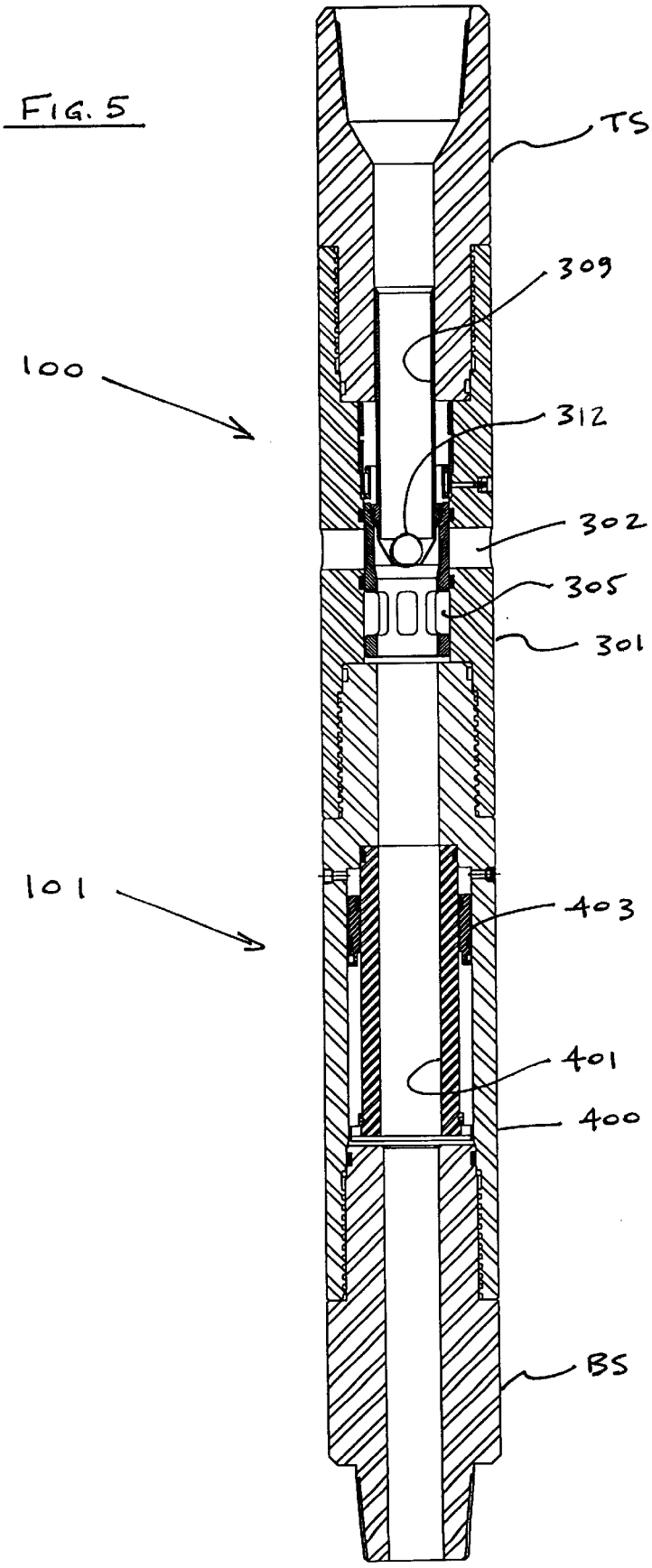
FIG. 5 is a sectional view of a preferred embodiment of the surge pressure reduction tool in accordance with the present invention comprising a diverter device in the close port position and a volume compensation device.
Figure 6:
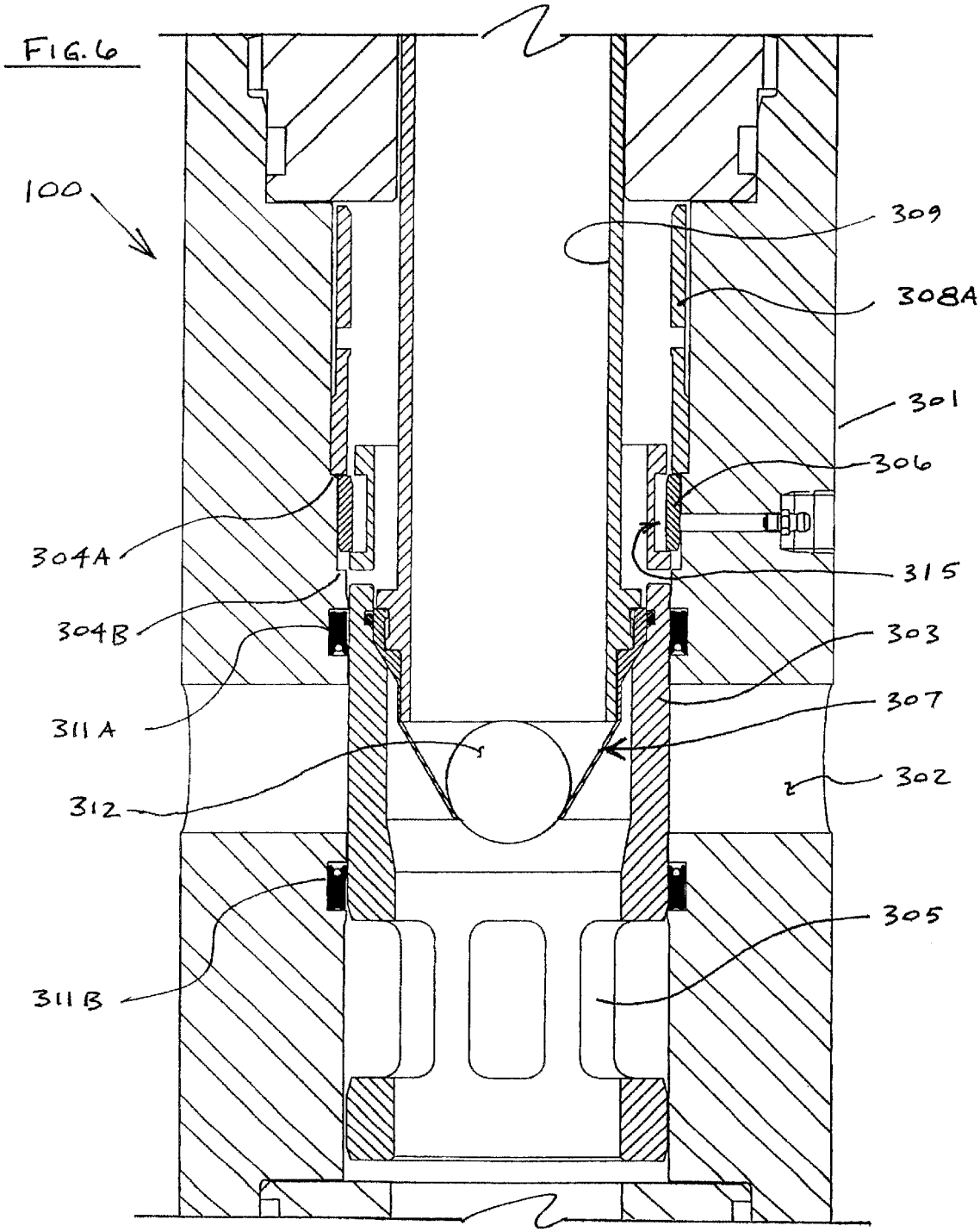
FIG. 6 is an enlarged sectional view of a preferred embodiment of the diverter device in the closed port position.

A sleeve 303 having an upper end, a lower end, and a set of flow ports 305 formed therein is arranged within the axial bore of the housing assembly 301. When the set of flow ports 305 of the sleeve 303 are aligned with the set of flow holes 302 of the housing assembly 301, the diverter device 100 is in an "open port position." In the open port position, communication is established between the axial bore of the housing assembly 301 and the annular space outside the housing assembly. When the set of flow ports 305 of the sleeve 303 are not aligned with the set of flow holes 302 of the housing assembly 301 such that the sleeve blocks the set of housing flow holes, the diverter device 100 is in a "closed port position" (FIGS. 5 and 6). In the closed port position, communication between the axial bore of the housing assembly 301 and the annular space outside the housing assembly is interrupted. The housing assembly 301 includes an upper seal 311A and a lower seal 311B for sealing with the outer wall of the sleeve 301. The upper seal 311A and the lower seal 311B are preferably O-rings installed in the housing assembly 301 rather than the sleeve 303 so that the seals do not cross the set of housing flow holes 302. In the appended claims, the term "diverting means" refers to the housing assembly 301 with the set of flow holes 302 and the sleeve 303 with the set of flow ports 305 of the diverter device 100 used to divert the flow of drilling fluid.

Furthermore, the diverter device 100 includes an indexing mechanism to shift the sleeve 303 from the open port position to the closed port position. A circumferential groove 315 is formed on the upper end of the sleeve 303 to receive a spring ring 306. The spring ring 306 is biased radially outward and is held in a compressed state by a shear ring 308A. The shear ring 308A engages the upper groove 304A of the housing assembly 301 and holds the sleeve 303 in place using a set of shear pins 308B. It should be understood that the quantity of shear pins comprising the set of shear pins 308B will govern the pressure at which the diverter device 100 shifts from the open port position to the closed port position.

With further reference to FIGS. 2 and 3, the diverter device 100 also includes a yieldable ball seat 307 and a drop ball 312 (FIGS. 5 and 6) for shifting the sleeve 303 from the open port position to the closed port position. The yieldable ball seat 307 is installed on a shoulder formed in the sleeve 303. The lower end of a dart directing sleeve 309 is installed on top of the yieldable ball seat 307, and a snap ring 310 is utilized to secure the yieldable ball seat and dart directing sleeve in place on the upper end of the sleeve 303. The dart directing sleeve 309 fits in an opening in top sub TS and functions to center a dart (not shown) on the yieldable ball seat 307 during cementing operations. In the appended claims, the term "shifting means" refers to the spring ring 306, the yieldable ball seat 307, and the drop ball 312 of the indexing mechanism used to shift the sleeve 303 from the open port position to the closed port position.

Figure 4:
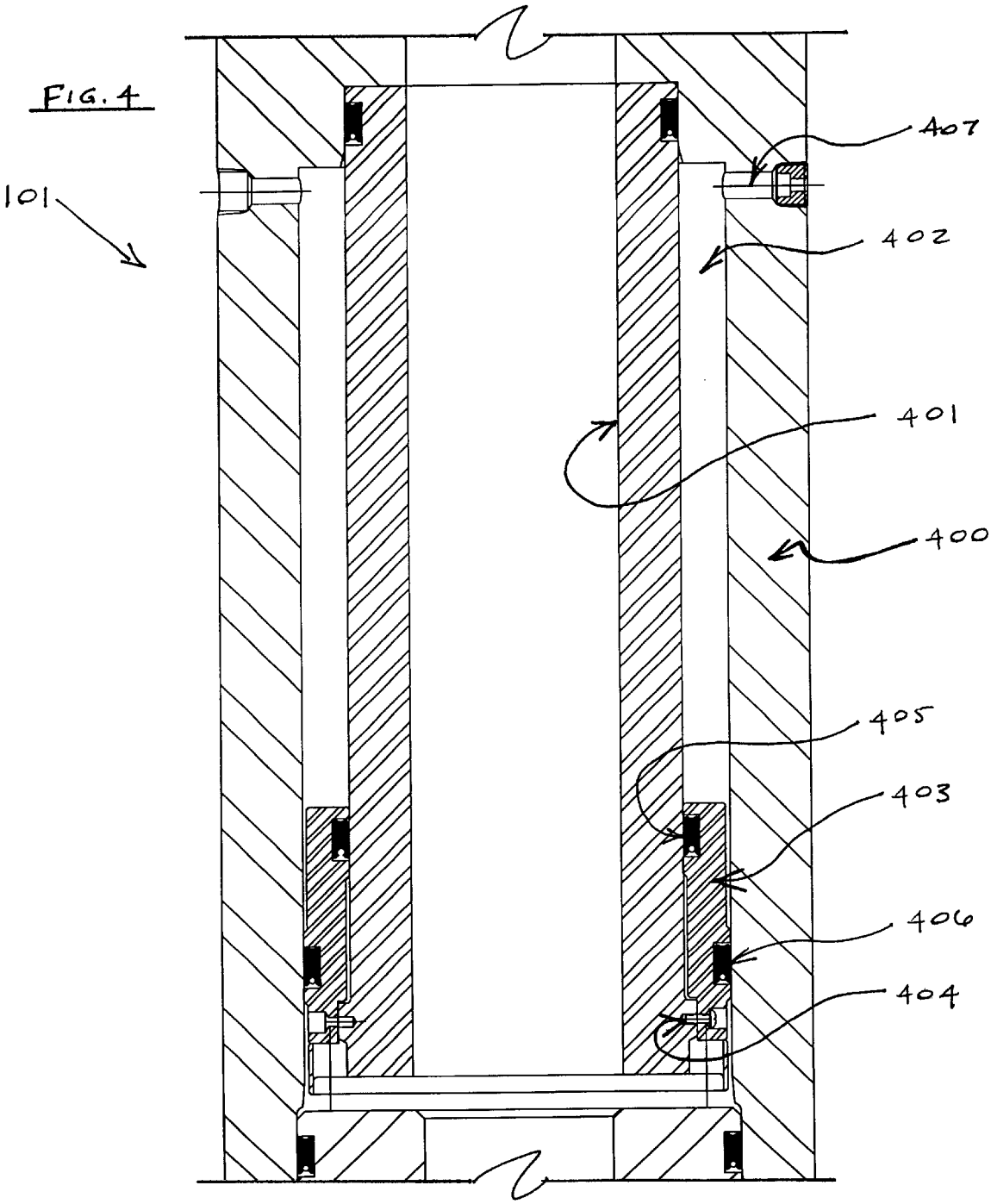
FIG. 4 is an enlarged sectional view of a preferred embodiment of the volume compensation device depicting an annular piston connected to an inner sleeve by a shear pin.

With reference to FIGS. 2 and 4, a preferred embodiment of the present invention may also include a volume compensation device 101 comprising a housing 400 having an upper end and a lower end and an axial bore formed therethrough. The volume compensation device 101 further includes an inner sleeve 401 with an upper end and a lower end and having an outer diameter smaller than the diameter of the axial bore of the housing 400. The total length of the inner sleeve 401 is less than the length of the inner bore of the housing 400. The inner sleeve 401 is arranged within the housing 400 and the upper end of the sleeve is attached to the upper end of the housing to form a compensation volume annulus 402 between the inner sleeve and the housing. An annular piston 403 having an inner diameter approximately equal to the outer diameter of the inner sleeve 401 and an outer diameter approximately equal to the diameter of the axial bore of the housing 400 is attached to the lower end of the sleeve by a set of one or more shear pins 404. The annular piston 403 includes an inner seal 405 for sealing with the outer wall of the inner sleeve 401 and an outer seal 406 for sealing with the axial bore of the housing 400. The inner seal 405 and the outer seal 406 are preferably O-rings. The housing 400 also has at least one hole 407 formed therein near the upper end to establish communication between the compensation volume annulus 402 and the borehole BH (FIG. 1). In the appended claims, the term "volume compensating means" refers to the volume compensation device 101 used to accumulate a sufficient volume of drilling fluid to permit the sleeve 303 of the diverter device 100 to be shifted from the open port position to the closed port position.

With respect to FIGS. 1–4, in operation, the diverter device 100 is run into a borehole BH with the set of shear pins 308B holding the sleeve 303 such that the set of flow holes 302 of the housing assembly 301 is aligned with the set of flow ports 305 of the sleeve. In this "open port position," a flow path exists for drilling fluid to flow upward from the borehole BH into the drilling/production liner 103, through the volume compensation device 101 and diverter device 100A, and outward to the annular space between the drill string S and surface casing C2 via the set of housing flow holes 302.

The drilling/production liner 103 is run into the borehole with the diverter device 100 in the open port position and thus the benefits of surge pressure reduction are realized. However, once total depth is reached, the diverter device 100 must be moved to the closed port position.

With reference to FIGS. 5 and 6, the diverter device 100A is shifted to the closed port position by releasing the drop ball 312 down the drill string S and into the yieldable ball seat 307. Drilling fluid pressure is then increased above the drop ball 312 and the yieldable ball seat 307 to a first predetermined level to shear the set of shear pins 308B (FIG. 3) which releases the sleeve 303 to move axially downward. The downward movement of the sleeve 303 is arrested when the circumferential groove 315 of the sleeve is aligned with the lower circumferential groove 304B of the housing assembly 301, because the spring ring 306 decompresses radially outward to engage the lower circumferential groove of the housing assembly. The diverter device 100 is now in the closed port position.

Once in the closed port position, drilling fluid pressure is increased to a second predetermined level above the drop ball 312 to force the drop ball through the yieldable ball seat 307. In this "closed port position," a flow path exists for drilling fluid to flow downward from the drill string S, through the diverter device 100 and volume compensation device 101, and outward into the borehole BH via the drilling/production liner 103.

With respect to the embodiment described above, if the passage through the drilling/production liner 103 is obstructed by drill cuttings or downhole debris, then releasing a drop ball 312 into the yieldable ball seat 307 will effectively trap the drilling fluid between the yieldable ball seat and the plugged drilling/production liner. Therefore, when drilling fluid pressure is increased above the drop ball 312 to shift the diverter device 100 into the closed port position, the trapped drilling fluid will resist the downward shifting of the sleeve 303. This condition is called "hydraulic lock." In this hydraulic lock condition, the sleeve 303 of the diverter device 100 cannot be shifted axially downward to block the set of housing flow holes 302. With the set of housing flow holes 302 unobstructed, circulation and, more significantly, critical cementing operations cannot be performed. Therefore, the volume compensation device 101, once activated, accumulates enough of the trapped drilling fluid to permit the sleeve 303 of the diverter device 100 to be shifted axially downward. Once a sufficient volume of the resisting drilling fluid is removed, the hydraulic lock condition ends and the sleeve 303 is moved to the closed port position.

Figure 7:
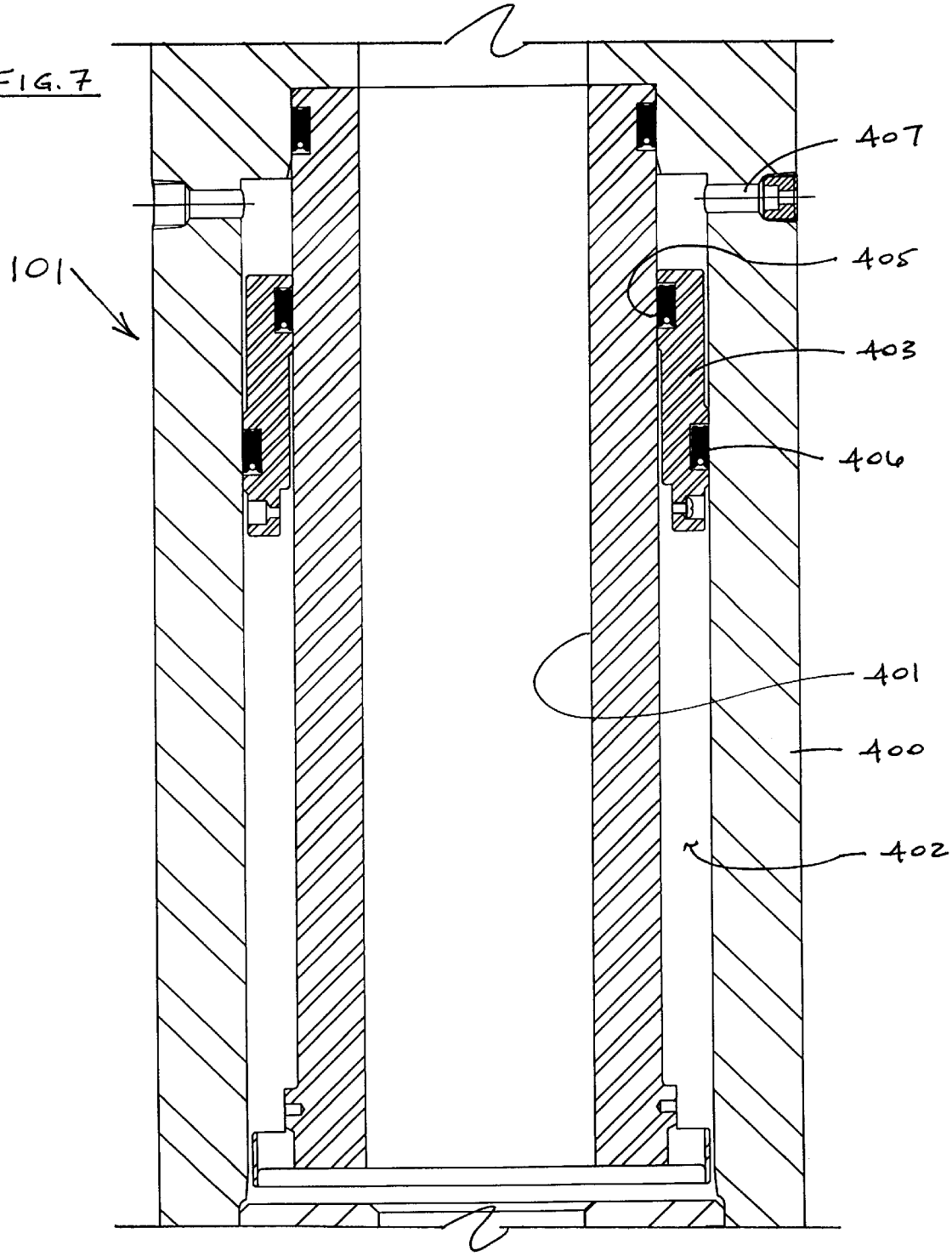
FIG. 7 is an enlarged sectional view of a preferred embodiment of the volume compensation device depicting an annular piston connected to an inner sleeve by a shear pin.

With reference to FIGS. 5–7, in operation, the volume compensation device 101 accumulates the trapped drilling fluid to enable the sleeve 303 of the diverter device 100 to shift to the closed port position. As the drilling fluid pressure above the drop ball 312 is increased, the trapped drilling fluid beneath the drop ball forces the annular piston 403 upward against the restraint of the shear pins 404. Once the force against the annular piston is sufficient to shear the shear pins 404, the volume compensation device is activated and the annular piston 403 is released from the lower end of the inner sleeve 401.

Once the annular piston 403 is released, the trapped drilling fluid forces the annular piston upwards. As the annular piston 403 moves upward, the drilling fluid fills the volume vacated by the rising piston. As the drilling fluid pressure above the drop ball 312 forces the sleeve 303 of the diverter device 100 to move axially downward, the trapped drilling fluid reacts by forcing the annular piston 403 further upward filling in the vacated space below the piston until enough drilling fluid has been displaced to shift the sleeve into the closed port position.

Furthermore, as the annular piston 403 moves axially upward, it sweeps any fluid that is collected in the compensation volume annulus 402 outward into the borehole via a set of holes 407. It is also intended that the compensation volume annulus 402 above the annular piston may be filled with a preservative compound such as grease to prevent contamination of the compensation volume annulus as the surge pressure reduction tool is run downhole.

Once the sleeve 303 of the diverter device 100 is in the closed port position and the set of housing flow holes 302 is blocked, drilling fluid pressure is increased above the drop ball 312 to push the drop ball through the yieldable ball seat 307. Now, a flow path is established through the diverter device 100 such that drilling fluid can be pumped through the drilling/production liner 103 (FIG. 1) to remove the plugged drill cuttings or downhole debris. Finally, with the diverter device 100 in the closed port position, circulation can be performed if the drilling/production liner 103 is in a tight hole condition or cementing operations can be commenced if the drilling/production liner is at total depth.

In the appended claims, the term "open port position" refers to a condition where the set of flow holes formed in the housing assembly of the diverter device is aligned with the set of flow ports formed in the sleeve of the diverter device; and the term "closed port position" refers to a condition where the set of flow holes formed in the housing assembly of the diverter device is blocked by the sleeve of the diverter device. Furthermore, the term "plugged" refers to a condition where passage through the tubular member is obstructed by drill cuttings or downhole debris. The term "connecting means" refers to the shearing ring and the set of shear pins used to fix the sleeve in the open port position. The term "actuating means" refers to the yieldable ball seat and the drop ball used to seal the seat such that drilling fluid pressure can be increased to shear the set of shear pins.

What is claimed is:

1. Apparatus for use in reducing surge pressure while running a tubular member through a borehole containing drilling fluid using a drilling rig, said apparatus comprising:

a drill pipe for communication between the drilling rig and the borehole, said drill pipe comprising an upper end operatively connected to the drilling rig and a lower end, a diverter device for directing flow of drilling fluid, said diverter device comprising:

a housing assembly having an upper end operatively connected to the lower end of the drill pipe and a lower end, said housing assembly having a set of flow holes formed therein;

a sleeve within the housing assembly having an upper end and a lower end, and a set of flow ports formed therein, said sleeve being movable between an open port position where the set of flow holes of the housing assembly is aligned with the set of flow ports of the sleeve and a closed port position where the set of flow holes is blocked by the sleeve; and means to shift the sleeve downward from an open port position to a closed port position, said means displacing a predetermined volume of drilling fluid to shift the sleeve downward from an open port position to a closed port position, an indexing mechanism to shift the sleeve from the open port position to the closed port position comprising: (i) a circumferential groove formed on the outer wall of the sleeve; (ii) a first circumferential groove formed on the inner wall of the housing assembly; (iii) a spring ring arranged within the circumferential groove of the sleeve, said spring ring being compressed when the sleeve is in the open port position and decompressed radially outward to engage the circumferential groove of the housing assembly when the sleeve is in the closed port position; (iv) connecting means for holding the sleeve in the open port position; and (v) actuating means for releasing the connecting means and for moving the sleeve from the open port position to the closed port position, and a volume compensation device which, when activated, accumulates a volume of drilling fluid equal to or greater than the volume of drilling fluid which is displaced when the sleeve of the diverter device is shifted from an open port position to a closed port position, said volume compensation device having an upper end operatively connected to the diverter device and a lower end operatively connected to the tubular member, wherein the connecting means comprises:

a second circumferential groove formed on the inner wall of the housing assembly above the first circumferential groove of the housing assembly;

a shear ring having an upper end and a lower end and an outer diameter less than the diameter of the axial bore of the housing assembly and an inner diameter greater than the diameter of the sleeve of the diverter device, said lower end of the shear ring engaging the second circumferential groove of the housing assembly; and a set of shear pins connecting the shear ring to the sleeve of the diverter device.

2. The apparatus of claim 1, wherein the actuating means comprises:

a yieldable ball seat arranged within and attached to the sleeve of the diverter device, said yieldable ball seat movable between a sealing position and a yielding position; and a ball which is dropped down the drill pipe and which seats in the yieldable ball seat.

3. The apparatus of claim 2, further comprising:

means for establishing a first pressure above the ball to shear the set of shear pins and move the sleeve of the diverter device downward until the circumferential groove of the sleeve and the first circumferential groove of the housing assembly are aligned thereby allowing the spring ring to decompress radially outward and engage the first circumferential groove of the housing; and means for establishing a second pressure above the ball to force the ball through the yieldable ball seat.

4. The apparatus of claim 3, wherein the housing assembly of the diverter device further comprises an upper seal on the inner wall of the housing assembly located directly above the set of flow holes and a lower seal on the inner wall of the housing assembly located directly below the set of flow holes.

5. The apparatus of claim 4, further comprising a dart directing sleeve having an upper end operatively connected with the lower end of the drill pipe and a lower end operatively connected to the yieldable ball seat.

6. The apparatus of claim 2, wherein the volume compensation device comprises: (a) a housing with an upper end operatively connected to the lower end of the housing assembly of the diverter device, a lower end operatively connected to the tubular member, and an axial bore formed therethrough, said housing having at least one flow hole formed near the upper end to establish communication between the axial bore of the housing and the borehole; (b) an inner sleeve positioned inside the housing with a total axial length less than the total length of the axial bore of the housing, said inner sleeve having an outer diameter smaller than the diameter of the axial bore of the housing to form an annular space between the housing and the inner sleeve; (c) a piston having an inner diameter approximately equal to the outer diameter of the inner sleeve and an outer diameter approximately equal to the diameter of the axial bore of the housing; and (d) means to attach the piston to the inner sleeve near the lower end of the housing.

7. The apparatus of claim 6, wherein the means to attach the piston to the inner sleeve is a set of shear pins.

8. The apparatus of claim 7, wherein the piston further comprises an inner seal to engage the inner sleeve and an outer seal to engage the axial bore of the housing.

9. The apparatus of claim 8, wherein communication though the tubular member is interrupted, further comprising:

means for establishing a first pressure above the ball which is sufficient to shear the set of shear pins of the diverter device and the set of shear pins of the volume compensation device to release the piston from the lower end of the inner sleeve of the volume compensation device and force the piston axially upward to provide volume for the sleeve of the diverter device to move downward from the open port position to the closed port position; and means for establishing a second pressure above the ball to force the ball through the yieldable ball seat.

10. The apparatus of claim 9, wherein the housing assembly of the diverter device further comprises an upper seal on the inner wall of the housing assembly located directly above the set of flow holes and a lower seal on the inner wall of the housing assembly located directly below the set of flow holes.

11. The apparatus of claim 10, further comprising a dart directing sleeve having an upper end operatively connected with the lower end of the drill pipe and a lower end operatively connected to the yieldable ball seat.

* * * * *